United States Patent [19]

Phillips et al.

[11] Patent Number: 4,908,966

[45] Date of Patent: Mar. 20, 1990

[54] BENTHIC DREDGE CONSTRUCTION

[75] Inventors: William H. Phillips, Saginaw; Bernhard W. Koepke, Frankenmuth, both of Mich.

[73] Assignee: Trippensee Corporation, Saginaw, Mich.

[21] Appl. No.: 278,674

[22] Filed: Dec. 1, 1988

[51] Int. Cl.[4] ..... B66C 3/02

[52] U.S. Cl. ..... 37/71; 37/185; 294/68.23; 24/574; 292/178

[58] Field of Search ..... 37/71, 183 A, 184–188; 294/68.23, 110.1; 292/DIG. 4, 62, 150, 177–178; 24/458, 523, 573, 574, 602

[56] References Cited

U.S. PATENT DOCUMENTS

| | | | |
|---|---|---|---|
| 827,635 | 7/1906 | Hone | 37/183 A |
| 866,124 | 9/1907 | Fox | 292/178 X |
| 1,126,375 | 1/1915 | Brinkerhoff | 292/150 |
| 3,762,078 | 10/1973 | Wetherbee | 37/71 X |
| 3,768,853 | 10/1973 | Rennie | 294/110.1 |
| 3,852,943 | 12/1974 | Healy | 24/459 X |
| 3,949,497 | 4/1976 | Crump | 294/68.23 X |

FOREIGN PATENT DOCUMENTS

| | | | |
|---|---|---|---|
| 238900 | 3/1965 | Austria | 294/68.23 |

OTHER PUBLICATIONS

Marine Geology, vol. IV, 1966, pp. 365–372, Elesiver Publishing Co., Amsterdam.

*Primary Examiner*—Randolph A. Reese
*Assistant Examiner*—Arlen L. Olsen
*Attorney, Agent, or Firm*—Learman & McCulloch

[57] ABSTRACT

A benthic dredge has a hollow body provided with closures at its upper and lower ends which are movable between open and closed positions. The closure at the lower end of the body is in the form of clamshell jaws which are pivotable about an axis located between the upper and lower ends of the body. Movements of the jaws are controlled by vertically reciprocable operating members and a force transmitting toggle linkage. No part of the linkage extends at any time beyond the confines of the body and the linkage is of such construction as to be capable of applying substantial closing force on the jaws as they approach their closed position.

18 Claims, 2 Drawing Sheets

BENTHIC DREDGE CONSTRUCTION

This invention relates to a dredge of the kind especially adapted for taking samples from the bottom of a body of water.

BACKGROUND OF THE INVENTION

A dredge of the kind adapted to take samples from the bottom of a body of water is known as a benthic sampling dredge and conventionally comprises a hollow body having closures at its upper and lower ends that are movable between open and closed positions. A conventional benthic dredge has a pair of clamshell jaws adapted to form a closure for the lower end of the body, and such clamshell jaws are pivoted on the body for movements between a position in which the bottom of the body is open to a position in which the clamshell jaws close the bottom of the body. The clamshell jaws conventionally are so constructed that, as they move toward the closed position, they cut a sample from the bottom of the body of water and support the sample whithin the body.

The closure at the upper end of the body is movable from a closed position to an open position, thereby facilitating lowering of the dredge through the body of water, and such closure is adapted to be closed prior to raising the dredge from the bottom, thereby minimizing the possibility of the sample's being washed out of the dredge body.

The clamshell jaws conventionally are spring biased toward their closed position and are releasably latched in their open position. Upon release of the latch, springs move the jaws toward their closed position. A typical dredge of the kind having spring biased clamshell closure jaws is disclosed in U.S. Pat. No. 3,762,078, issued Oct. 2, 1973.

One of the problems associated with conventional, spring biased clamshell jaws is that the driving force of the springs diminishes as the jaws approach their closed position. Consequently, debris which may lie in the path of closing movement of the jaws many times prevents complete closing of the jaws because the springs are incapable of applying sufficient force on the jaws to enable them to sever the obstruction. Thus, a good part of the sample may escape from the dredge as the latter is raised to the surface of the water.

Another disadvantage of spring biased jaws is that, over a period of time, the springs wear and lose some of their strength This, coupled with the reduction in applied force as the jaws move toward their closed position, increases the possibility that the jaws will not close fully and remain closed as the dredge is raised.

Not all benthic dredges in use heretofore have used springs for closing the jaws. Some of the known dredges have utilized a linkage operable to move the clamshell jaws between their open and closed positions. One such dredge is disclosed in Marine Geology, Volume IV, 1966, pages 365–372, and published by Elesiver Publishing Company, Amsterdam. This dredge has a number of disadvantages. For example, the linkage is so arranged that, as the jaws approach their closed position, the closing force is greatly diminished, thereby minimizing the ability of the jaws to cut through an obstruction. Further, the linkage is of such construction that, in some positions of the linkage, portions of the links extend beyond the confines of the dredge, thereby exposing the linkage to the possibility of damage of a kind that could cause malfunction of the jaw closing mechanism. In addition, such damage could adversely affect the mechanism for releasing the jaw closing mechanism and cause the latter to function erratically, particularly in bodies of water where there are currents.

A principal object of the present invention is to provide a benthic dredge which overcomes the above referred to disadvantages of known benthic dredges.

SUMMARY OF THE INVENTION

A benthic dredge constructed in accordance with the invention comprises a hollow body open at its top and bottom, but being provided with top and bottom closures movable between open and closed positions. The bottom closure comprises a pair of clamshell jaws that are pivoted on the body for pivotal movement about an axis. Pivotal movements of the jaws are effected by reciprocable operating means coupled to the jaws by a force transmitting linkage. The linkage is so constructed that no part thereof extends at any time beyond the confines of the dredge body. Further, the linkage is so constructed that, as the jaws approach their closed position, sufficient closing force may be applied to the jaws to ensure movement thereof to their completely closed position.

The operating means is slideable in a frame carried at the upper end of the dredge body. The frame also supports an anchor member that is cooperable with a retainer supported by the operating means. Both the anchor member and the retainer have openings which may register with one another when the clam-shell jaws are in the open position, thereby enabling a latch pin to be accommodated in the openings. A hoisting cable is fastened to the anchor member to enable the dredge to be lowered and raised in the body of water. As long as the weight of the dredge is supported by the cable, the latch pin will remain in the registered openings of the retainer and the anchor member. When the dredge strikes bottom, however, a spring forming part of the latch pin is enabled to eject the latch pin from the openings, thereby enabling relative movement between the retainer and the anchor member. Such relative movement enables the operating means to operate the jaw closing linkage and close the jaws to capture a sample within a body of the dredge. The cable then may be used to raise the dredge, whereupon the closure doors at the upper end of the dredge body will be closed.

THE DRAWINGS

A dredge constructed in accordance with the preferred embodiment of the invention is disclosed in the accompanying drawings, wherein.

THE PREFERRED EMBODIMENT

Figure 1:
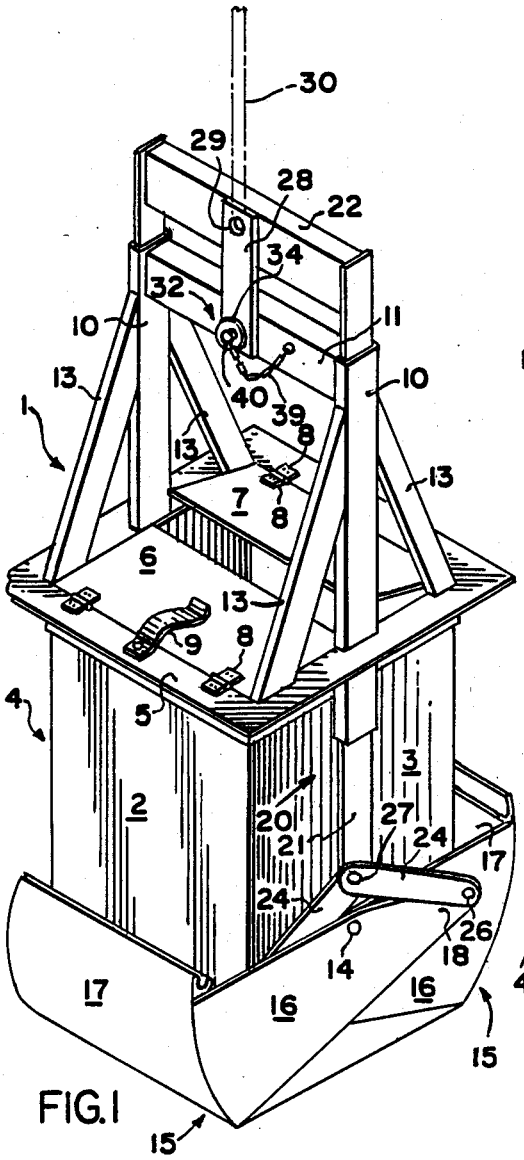
FIG. 1 is an isometric view of the dredge with its clamshell jaws latched in the open position.

A dredge constructed in accordance with the disclosed embodiment of the invention is designated generally by the reference character 1 and comprises parallel side walls 2 and parallel end walls 3, the walls 2 and 3 being joined in such manner as to provide a hollow, sleeve-like body 4 having a peripheral flange 5 at its upper end. A pair of closure doors 6 and 7 are pivoted by hinges 8 to the flange 5 and are swingable between open and closed positions. The doors 6 and 7 are biased by spring tongues 9 to their closed position, but are movable to their open position in response to downward movement of the body of the dredge through a body of water. If desired, the doors 6 and 7 can be of the same kind disclosed in Pat. No. 3,762,078 and may be moved between open and closed positions in the same manner disclosed in such patent.

Extending through openings in the flange 5 and fixed thereto is a pair of tubular slides 10 which are joined at their upper ends by a cross bar or anchor member 11. An opening 12 extends through the anchor member. The slides 10 are reinforced by suitable braces 13.

At a level between the upper and lower ends of the body 4 each of the walls 3 is provided with a fixed pivot pin or post 14. The posts define a substantially horizontal axis of rotation. Pivoted on the post 14 is a pair of clamshell closures or jaws 15, each of which has a pair of arms 16 straddling the body 4 and joined at their outer ends by arcuate webs 17. Each of the arms 16 has an extension 18 which projects a uniform distance beyond the adjacent post 14. One pair of arms and the associated extensions 18 overlap the other set of arms and their associated extensions. The arcuate webs 17 have cutting edges 19 that are adapted to confront one another and such edges, if desired, may be hardened or reinforced with appropriate materials.

Operating means 20 is provided for moving the jaws 15 in unison between their open and closed positions. The operating means comprises a pair of reciprocable operating members 21 slideably accommodated in the slides 10. The members 21 are joined at their upper ends by a cross bar 22, thereby enabling the members 21 to move in unison.

The lower ends of the members 21 project beyond the slides 10 and are coupled to the jaws 15 by a force transmitting toggle linkage 23. The toggle linkage comprises a pair of links, 24 pivoted at 26 to the respective arm extensions 18. The rigid links 24 also are pivoted at 27 to one another and to the lower ends of the respective members 21. The arrangement is such that vertical reciprocating movements of the operating members 21 effect pivotal movements of the jaws 15 about the axis formed by the posts 14 so as to move the jaws between their open and closed positions.

Fixed to the cross bar 22 is a depending retainer strap 28. At its upper end the strap 28 has an opening 29 in alignment with an opening (not shown) in the cross bar 22 so as to enable one end of a hoisting cable 30 to be secured to the cross bar. At its lower end the retainer 28 has an opening 31 registers with the opening 12 in the anchor member 11 when the jaws 15 are in their open position.

A latch pin 32 is provided for latching the jaws 15 in their open position and comprises a body 33 having an enlarged head 34 at one end and a reduced diameter unitary shank or extension 35 terminating at its opposite end in a nose. Between the head 34 and the free end of the shank 35 is a shoulder 36. A helical spring 37 has an end convolution snugly accommodated in a groove 38 adjacent the head 34. The spring is of such length that, when unstressed, it completely encircles the body 33 and most of the shank 35. A retaining chain 39 has one end fixed to the anchor member 11 and its other end fixed to the head 34 by a rivet 40.

The pin shank 35 is of such diameter as to pass freely through the openings 12 and 31 in the anchor member 11 and the retainer 28, respectively, but the diameter of the body 33 is larger than that of the opening 31, thereby precluding accommodation of the body 33 in either of the openings 12 or 31. The shoulder 36 forms a seat engageable with the retainer 28 to limit the distance that the shank 35 projects through the members 11 and 28 and the extent of compression of the spring 37.

Figure 4:
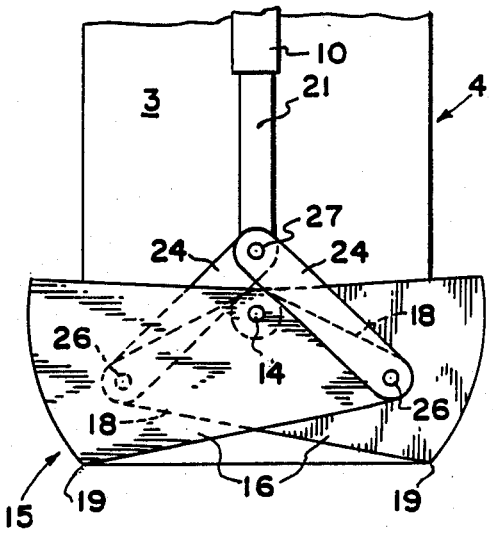
FIG. 4 is a fragmentary, end elevational view illustrating the jaws in their open position.

To condition the apparatus for use, the operating means 20 is moved downwardly relative to the slides 10 until the opening 31 in the retainer 28 registers with the opening 12 in the anchor member 11. In these positions of the parts, the jaws 15 will be open as shown in FIGS. 1 and 4. The shank 35 of the latch pin 32 may be fitted into the openings 12 and 31 until the shoulder 36 abuts the retainer 28. Such movement of the latch 32 will compress the spring 37, thereby biasing the latch 32 in a direction to withdraw the pin shank 35 from the openings 12 and 31.

Following insertion of the latch pin shank 35 into the openings 12 and 31, the latch pin is maintained manually in such position until the dredge is suspended from the cable 30. Once the dredge is suspended from the cable, the members 11 and 12 will exert a binding force on the latch pin shank 35 which is greater than the force exerted on the latch pin by the spring 36. The jaws 15, therefore, will be latched in their open position.

The dredge may be lowered via the cable 30 toward the bottom of the body of water. As the dredge is lowered the closure doors 6 and 7 will move to their open position as a result of the passage of water through the body 4.

When the dredge strikes the bottom of the body of water the cable 30 will slacken, thereby releasing the binding force on the latch 32 whereupon the spring 37 will eject the pin shank 35 from the openings 12 and 28. Once the latch pin has been ejected, an upward force applied to the cable 30 will cause the operating means 20 to move upwardly relative to the dredge body 4. The weight of the dredge is sufficient to ensure that upward movement of the operating members 21 will be transmitted via the toggle linkage 23 to the jaws 15 so as to rock the latter from their open position to their closed position As the jaws move to their closed position they will cut a sample from the bottom of the body of water and such sample will be accommodated in the body 4. Further upward movement of the cable 30 will cause the dredge 1 to be raised, and the resistance to upward movement of the dredge caused by the water will assist the springs 9 in closing the doors 6 and 7.

Figure 5:
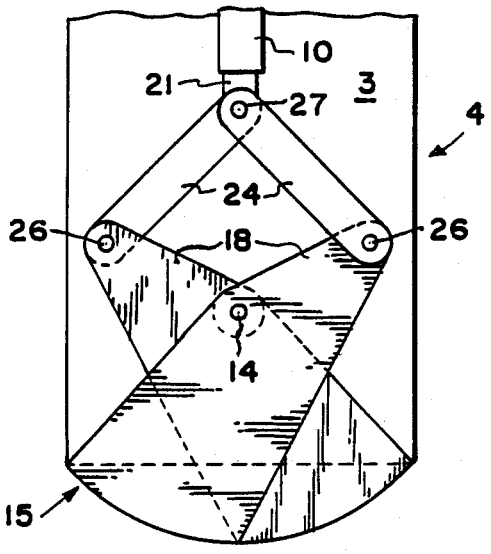
FIG. 5 is a view similar to FIG. 4, but showing the jaws in their closed position.

A particularly significant characteristic of the invention resides in the construction of the means by which the jaws are moved between their open and closed positions. As is best shown in FIGS. 4 and 5, the lengths of the arm extensions 18 from the axis of the post 14 and the lengths of the links 24 are such that, at no time, does any part of the links 24 or the extensions 18 project beyond the confines of the dredge body 4. Thus, regardless of whether the jaws 15 are in their open or closed position, no part of the operating linkage projects beyond the dredge body for exposure to possible damage.

Figure 2:
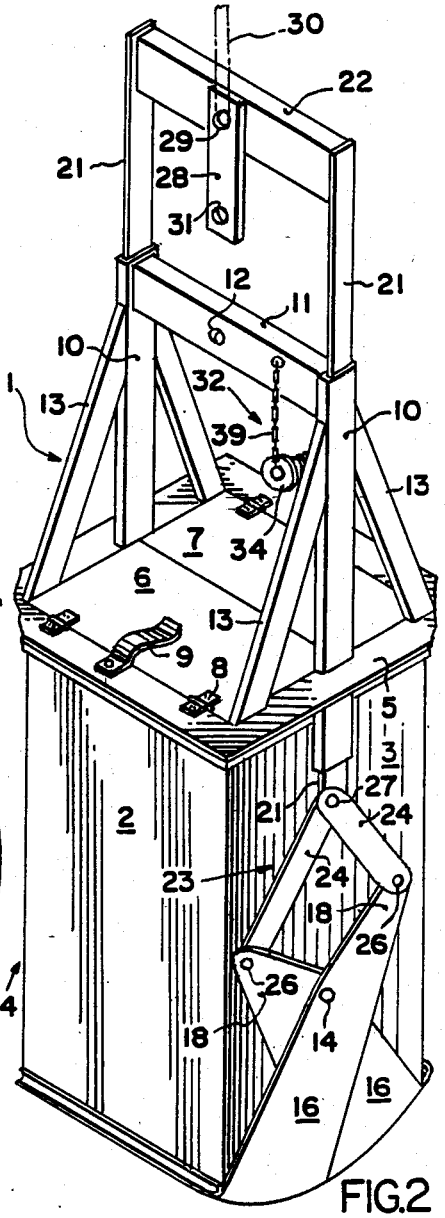
FIG. 2 is a view similar to FIG. 1, but illustrating the jaws in their closed position.
Figure 6:
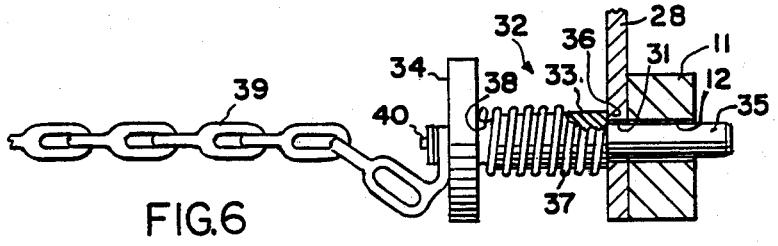
FIG. 6 is a greatly enlarged view, partly in section, illustrating the latching mechanism.
Figure 3:
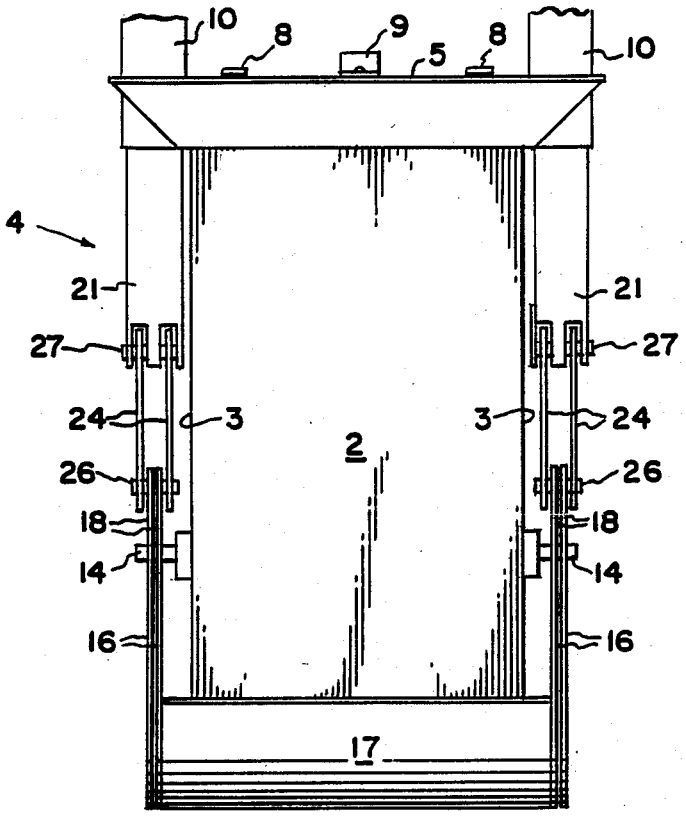
FIG. 3 is a fragmentary, side elevational view of the dredge with its jaws in their closed position.

Although the arm extensions 18 and the links 24 are relatively short, as compared to prior art constructions so as to avoid projecting beyond the confines of the dredge body, the extent of movement of the pivoted ends of the jaw extensions 18 is from a level below that of the axis defined by the pivots 14 to a level above that of such axis. See particularly FIGS. 4 and 5. The range of such movement preferably is such that the axis formed by the pivots 14 is equidistant between the upper and lower levels of the pivoted arms 18. The significance of this is that, as the jaws 15 approach their fully closed position, as is shown in FIGS. 2 and 5, continued upward movement of the operating members 21 enables considerable force to be applied to the jaws, thereby making it possible for their confronting edges 19 to sever debris and permit the jaws to move to the fully closed position.

The disclosed embodiment is representative of a presently preferred form of the invention, but is intended to be illustrative rather than definitive thereof. The invention is defined in the claims.

What is claimed is:

1. A dredge construction comprising a hollow body having a top and a bottom; a pair of clamshell closures; means pivoting said closures on said body for rocking movements between first and second positions in which said closures respectively open and fully close said bottom, said closures being rockable about an axis located at a level between said top and said bottom; movable operating means; and rigid force transmitting means coupling said operating means and said closures for rocking said closures between said positions in response to movements of said operating means, the coupling between said force transmitting means and said closures occupying a level below that of said axis when said closures are in said first position.

2. The construction according to claim 1 wherein the coupling between said force transmitting means and said closures occupies a level above that of said axis when said closures are in said second position.

3. The construction according to claim 1 wherein the level of said coupling when said closures are in said second position and the level of said coupling when said closures are in said first position respectively are substantially equidistant below and above said axis.

4. The construction according to claim 1 wherein said operating means is reciprocable.

5. The construction according to claim 1 wherein said force transmitting means comprises a toggle linkage.

6. The construction according to claim 1 including releasable latch means reacting between said body and said operating means for latching said members in said first position.

7. The construction according to claim 6 wherein said latch means comprises a pin extending through aligned openings in said operating means and a part of said body.

8. The construction according to claim 7 including spring means acting on said pin and biasing the latter in a direction outwardly of said openings.

9. The construction according to claim 1 including closure means carried by said body for movements between positions in which the top of said body is respectively open and closed.

10. A dredge construction comprising a hollow body having a top and a bottom; a pair of clamshell closures pivoted on said body for rocking movements about an fixed axis between first and second positions in which said closures respectively open and fully close said bottom; operating means; means mounting said operating means for vertical reciprocating movements; rigid force transmitting means pivotally connecting said operating means to said closures for effecting rocking movements of said closures in response to movements of said operating means; anchor means carried by said body; retaining means carried by said operating means; and releasable latch means reacting between said anchor means and said retaining means for latching said closures in said first position.

11. The construction according to claim 10 wherein said anchor means and said retaining means overlie one another when said closures are in said first position, and wherein said latch means is in engagement with said anchor means and said retaining means when said members are in said first position.

12. The construction according to claim 11 wherein said anchor means and said retaining means have openings therein in register when said closures are in said first position and wherein said latch means comprises a pin extending through both of said openings.

13. The construction according to claim 12 including spring means acting on said pin and biasing the latter in a direction outwardly of said openings.

14. The construction according to claim 12 including means for limiting the extent that said pin may extend into said openings.

15. The construction according to claim 10 wherein said force transmitting means is of such length that no part thereof extends at any time beyond the confines of said body.

16. The construction according to claim 10 wherein the connection of said force transmitting means to said closures is movable in response to movement of said closures from said first position to said second position from a position below the level of said axis to a position above the level of said axis.

17. The construction according to claim 16 wherein said axis is substantially equidistant between said levels.

18. The construction according to claim 10 wherein each of said closures has an extension projecting beyond said axis, the connection between said force transmitting means and said closures being at said extensions.

* * * * *